US012460874B2

(12) United States Patent
Roman

(10) Patent No.: US 12,460,874 B2
(45) Date of Patent: Nov. 4, 2025

(54) TWO-PHASE REFRIGERANT PUMP BLADDER CONTROL SYSTEM

(71) Applicant: Government of the United States, as represented by the Secretary of the Air Force, Wright-Patterson AFB, OH (US)

(72) Inventor: Abdeel J. Roman, Dayton, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 217 days.

(21) Appl. No.: 18/364,984

(22) Filed: Aug. 3, 2023

(65) Prior Publication Data

US 2025/0044039 A1 Feb. 6, 2025

(51) Int. Cl.

| | |
|---|---|
| ***F25B 9/00*** | (2006.01) |
| ***F25B 45/00*** | (2006.01) |
| ***F28D 15/02*** | (2006.01) |
| ***F28D 15/06*** | (2006.01) |

(52) U.S. Cl.

CPC ..... *F28D 15/06* (2013.01); *F28D 15/025* (2013.01); *F25B 9/008* (2013.01); *F25B 45/00* (2013.01); *F25B 2600/17* (2013.01)

(58) Field of Classification Search

CPC ..... F25B 45/00; F25B 9/008; F25B 2600/17
See application file for complete search history.

(56) References Cited

U.S. PATENT DOCUMENTS

| | | | | |
|---|---|---|---|---|
| 5,170,632 | A * | 12/1992 | Reilly, Jr. | F25B 45/00 D34/24 |
| 5,497,631 | A * | 3/1996 | Lorentzen | F25B 45/00 62/174 |
| 10,557,653 | B1 * | 2/2020 | Buschur | F25B 41/335 |
| 10,746,440 | B2 | 8/2020 | Donovan et al. | |

(Continued)

FOREIGN PATENT DOCUMENTS

| | | | | |
|---|---|---|---|---|
| KR | 20160129029 | A * | 1/2015 | |
| WO | WO-2024168042 | A1 * | 8/2024 | F04D 29/063 |

OTHER PUBLICATIONS

Translation of KR20160129029A named Translation—KR20160129029A (Year: 2016).*

*Primary Examiner* — Paul Alvare
(74) *Attorney, Agent, or Firm* — AFMCLO/JAZ; Richard M. Mescher

(57) ABSTRACT

A bladder control system for a two-phase pump loop (TPPL) includes an air compressor, an air line connected to the air compressor, first and second solenoid valves located along the air line, a refrigerant tank having a port operatively connected to the TPPL for selective flow of refrigerant between the refrigerant tank and the TPPL, an expandable bladder located within the refrigerant tank and having a port connected to the air line between the first and second solenoid valves for selective flow of air between the expandable bladder and the air line, and a controller. The controller selectively expands and contracts the expandable bladder to control flow of refrigerant out of the refrigerant tank to the TPPL and into the refrigerant tank from the TPPL for maintaining the system refrigerant pressure within a desired tight range. This is particularly useful for obtaining tight temperature control at the thermal load.

18 Claims, 5 Drawing Sheets

(56) References Cited

U.S. PATENT DOCUMENTS

| | | | |
|---|---|---|---|
| 10,775,110 | B2 | 9/2020 | Snyder et al. |
| 10,921,042 | B2 | 2/2021 | Donovan et al. |
| 11,162,388 | B1 | 11/2021 | Snyder et al. |
| 11,530,844 | B2 | 12/2022 | Unton et al. |
| 2019/0316818 | A1 | 10/2019 | Spangler et al. |
| 2022/0090868 | A1 | 3/2022 | Donovan et al. |
| 2022/0151102 | A1 | 5/2022 | Snyder |

* cited by examiner

TWO-PHASE REFRIGERANT PUMP BLADDER CONTROL SYSTEM

RIGHTS OF THE GOVERNMENT

The invention described herein may be manufactured and used by or for the Government of the United States for all governmental purposes without the payment of any royalty.

FIELD OF THE INVENTION

The present invention generally relates to a control system for a cooling system and, more particularly, to a bladder control system which commands system pressure of a two-phase pump loop (TPPL) cooling system using a bladder tank to add or remove refrigerant to or from the TPPL cooling system.

BACKGROUND OF THE INVENTION

Conventional two-phase pump loop (TPPL) systems for dissipating thermal loads during operation of heat-generating devices are well known. As shown in FIG. 1, a conventional TPPL system 10 forms a loop 12 through which a working fluid flows. The working fluid is typically a coolant or refrigerant. The illustrated TPPL system 10 includes a vapor/liquid receiver 14 which holds both vapor and liquid forms of the working fluid, a pump 16 which pumps the working fluid through the loop 12, an evaporator 18 where the working fluid absorbs heat 20 from the heat-generating device, and a condenser 22 where heat 24 is rejected from the working fluid and then the working fluid flows back to the vapor/liquid receiver 14. In this conventional TPPL system 10, the working fluid is allowed to boil as it passes through the evaporator 18 to remove heat from the heat load such as a hot surface of the heat-generating device. Boiling the working fluid across the entire surface of the evaporator 18 can offer a further advantage: the evaporator 18 has a very uniform surface temperature, typically within a few degrees. This near-isothermal performance is essential for many applications such as, for example but not limited to high-energy laser (HEL) devices, whose wavelength emissions are sensitive to temperature variations, to avoid signal loss etc. Thus, HEL devices need to be actively cooled to remain within their operating temperature range.

However, such a TPPL system 10 can encounter flow instability, temperature oscillations, and pressure changes that make the TPPL system 10 challenging to control during transient operations. Flow instabilities and temperature oscillations can be encountered while transitioning between idle and fire operating conditions. During idle operations, the condenser 22 is set to maintain saturated liquid conditions flowing through the pump 16. During fire operations, the condenser 22 is set to remove the excess heat transferred to the working fluid. These operating conditions can significantly affect stability of the TPPL system 10.

Accordingly, there is a need for control systems for TPPL cooling systems that controls saturation pressure of the refrigerant within the TPPL cooling system in order to maintain tight temperature control at the heat load while reducing and/or eliminating system flow instabilities and/or temperature oscillations during transient operations all in a cost-effective manner.

SUMMARY OF THE INVENTION

The present invention overcomes the foregoing problems and other shortcomings, drawbacks, and challenges of avoiding flow instabilities and/or temperature oscillations in TPPL cooling systems during transient operations. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention a bladder control system for a two-phase pump loop comprises an air compressor having an outlet, an air outlet, a refrigerant tank having a port configured for connection with the two-phase pump loop for selective flow of refrigerant between the refrigerant tank and the two-phase pump loop, an expandable bladder located within the refrigerant tank and having a port selectively connected to the outlet of the air compressor and selectively connected to the air outlet, and a controller. The controller is configured and operably connected to the air compressor to selectively expand and contract the expandable bladder within the refrigerant tank to control flow of refrigerant through the port of the refrigerant tank. Expansion of the expandable bladder discharges refrigerant from the bladder tank though the port of the bladder tank and contraction of the expandable bladder intakes refrigerant into the bladder tank though the port of the bladder tank.

According to another embodiment of the present invention, a two-phase pump loop system comprises a two-phase pump loop and a bladder control system. The two-phase pump loop comprises a vapor/liquid receiver configured to hold both vapor and liquid forms of refrigerant, a pump located downstream of the vapor/liquid receiver and configured to pump the refrigerant through the two-phase pump loop, an evaporator located downstream of the pump and configured for the refrigerant passing therethrough to absorb heat, and a condenser located downstream of the evaporator and configured to reject heat from the refrigerant passing therethrough. Refrigerant exiting the condenser is returned to the vapor/liquid receiver. The bladder control system comprises an air compressor having an outlet, an air outlet, a refrigerant tank having a port configured for connection with the two-phase pump loop for selective flow of refrigerant between the refrigerant tank and the two-phase pump loop, an expandable bladder located within the refrigerant tank and having a port selectively connected to the outlet of the air compressor and selectively connected to the air outlet, and a controller. The controller is configured and operably connected to the air compressor to selectively expand and contract the expandable bladder within the refrigerant tank to control flow of refrigerant through the port of the refrigerant tank. Expansion of the expandable bladder discharges refrigerant from the bladder tank though the port of the bladder tank and contraction of the expandable bladder intakes refrigerant into the bladder tank though the port of the bladder tank.

According to yet another embodiment of the present invention, a the bladder control system comprises an air compressor having an outlet, an air outlet, a refrigerant tank having a port configured for connection with the two-phase pump loop for selective flow of refrigerant between the refrigerant tank and the two-phase pump loop, an expandable bladder located within the refrigerant tank and having a port selectively connected to the outlet of the air compressor and selectively connected to the air outlet, and a controller configured and operably connected to the air compressor to selectively expand and contract the expandable bladder within the refrigerant tank to control flow of refrigerant through the port of the refrigerant tank, and wherein expansion of the expandable bladder discharges refrigerant from the bladder tank though the port of the bladder tank and contraction of the expandable bladder intakes refrigerant into the bladder tank though the port of the bladder tank. A method of operating the bladder control system for a two-phase pump loop, comprising the steps of inputting a set minimum system pressure and a set maximum system pressure to the system controller, providing a reading of current system pressure to the system controller, determining, by the system controller, whether the current system pressure is less than the set minimum system pressure, if the current system pressure is less than the set minimum system pressure, automatically supplying, by the system controller, compressed air to the expandable bladder to add a refrigerant charge to the two-phase pump loop until the current system pressure is equal to or greater than the set minimum system pressure, determining, by the system controller, whether the current system pressure is greater than the set maximum system pressure, if the current system pressure is greater than the set maximum system pressure, automatically releasing, by the system controller, compressed air from the expandable bladder to remove a refrigerant charge from the two-phase pump loop until the current system pressure is equal to or less than the set maximum system pressure.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

Figure 1:
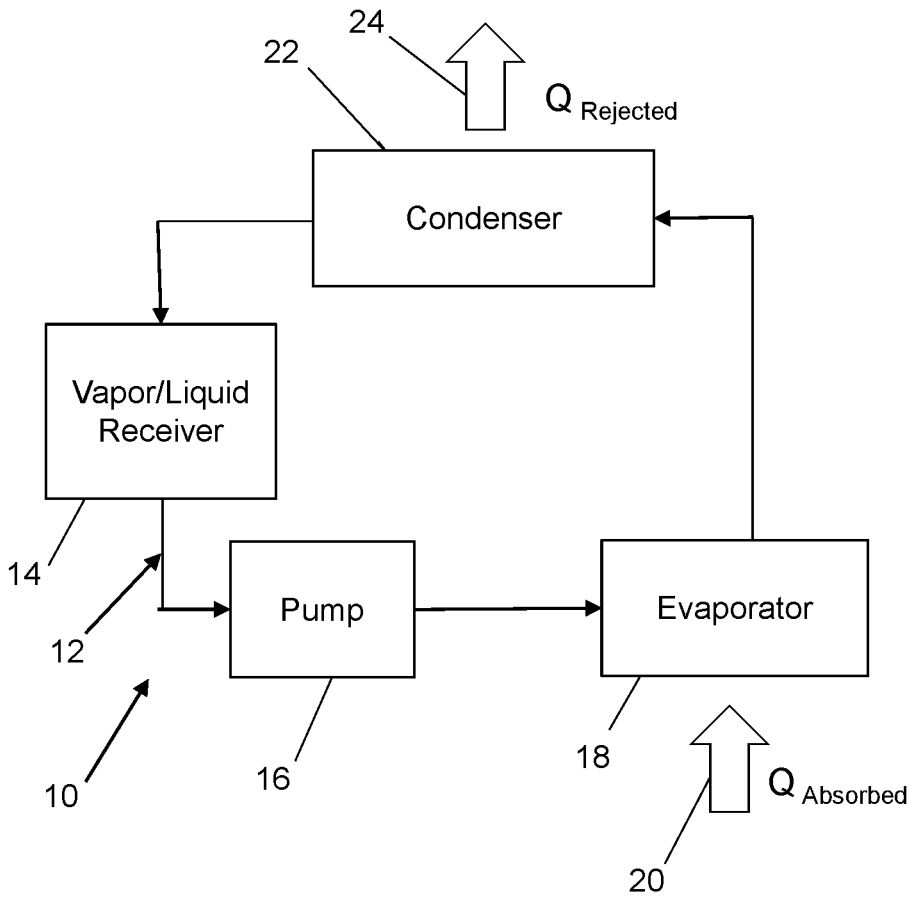
FIG. 1 Prior Art
FIG. 1 is a block diagram of a two-phase pump loop according to the prior art.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

The following description is merely exemplary in nature and is in no way intended to limit the present disclosure or its application or uses. For example, the thermal management systems and methods for a TPPL made and used according to the teachings contained herein is described throughout the present disclosure in conjunction with cooling a high-energy laser (HEL) in order to more fully illustrate the composition and the use thereof. The incorporation and use of such thermal management systems and methods for a TPPL in other industrial and military applications that may include any apparatus, device, or combination of apparatuses or devices that consume electricity and may benefit from cooling and/or heating are contemplated to be within the scope of the present disclosure. Such apparatuses or devices include, for example but not limited to, solid state electronics, light-emitting diodes (LEDs), analog circuits, digital circuits, computers, servers, server farms, data centers, hoteling circuits such as vehicle electronics, vehicles, aircrafts, directed-energy weapons, lasers, plasma weapons, railguns, microwave generators, pulse-powered devices, satellite uplinks, electric motor generators, electric devices, fiber optic components, or the like.

For the purposes of this disclosure, the terms "about" and "substantially" are used herein with respect to measurable values and ranges due to expected variations known to those skilled in the art (e.g., limitations and variability in measurements).

For the purposes of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one source", "one or more sources", and "source(s)" may be used interchangeably and are intended to have the same meaning.

For the purposes of this disclosure, the term "line" is used to describe a conduit, tube, pipe, tunnel, pipe, passage through which a fluid passes.

For the purpose of this disclosure, the term "tight" temperature control describes controlling a temperature condition with minimal variation, such as ±5° C.; alternatively, ±3° C.; alternatively, ±1° C.; alternatively, ±0.5° C. When desirable, this control over the variation in temperature may also be expressed as a percentage of the measured temperature. For example, as the measured temperature is controlled to be within ±10%; alternatively, ±5%; alternatively, ±3%; alternatively, ±1%.

For the purpose of this disclosure the term, "valve" is used to describe a device attached to a line which controls flow of a fluid through that line.

Figure 2:
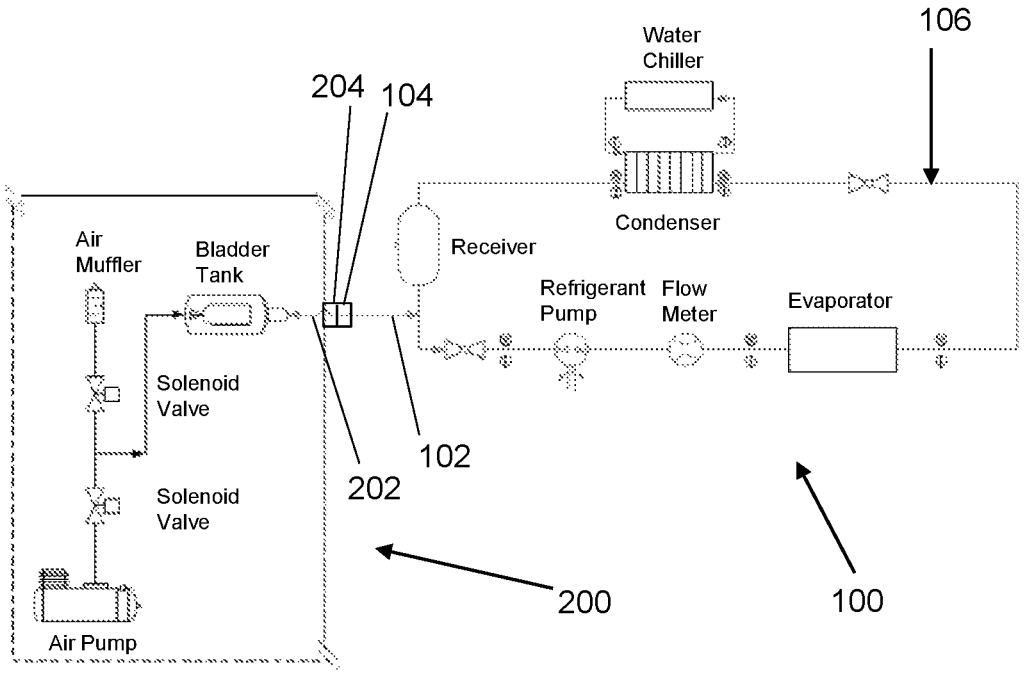
FIG. 2 is a schematic view of a two-phase pump loop system with a bladder control system according to the present invention.
Figure 2A:
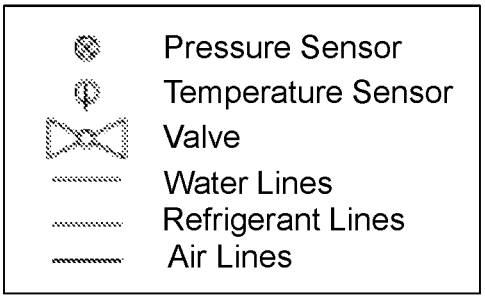
FIG. 2A is symbol key for FIG. 2.

FIGS. 2 and 2A illustrate a two-phase pump loop (TPPL) system 100 having a TPPL bladder control system 200 connected thereto for controlling the saturation pressure of coolant or refrigerant circulating within the TPPL system 100. Note that the temperature of the refrigerant, being the saturation temperature of the refrigerant, is based on the pressure of the refrigerant within the TPPL system 100. Thus, precise control of the saturation pressure enables the temperature of the refrigerant to be held within a tight tolerance. The illustrated TPPL bladder control system 200 has a refrigerant line 202 with a fluid-flow fitting 204 for releasably connecting with a cooperating fluid flow fitting 104 of a refrigerant line 102 of the TPPL system 100 to form a fluid-flow coupling. The refrigerant lines 102, 202 and the fittings 104, 204 forming the coupling can be of any suitable type which enable free flow of the refrigerant between the TPPL system 100 and the TPPL bladder control system 200 as described in more detail hereinbelow. It is noted that the refrigerant connection between the TPPL system 100 and the TPPL bladder control system 200 can alternatively be of any other suitable configuration and/or type.

The refrigerant circulated in the TPPL system 100 may be any substance suitable for use in a TPPL 106. In other words, the refrigerant may be any substance suitable for use in a refrigeration system or that experiences a phase change. The refrigerant may include, for example but not limited to, a chlorofluorocarbon (CFC), a hydrochlorofluorocarbon (HCFC), a hydrofluorocarbon (HFC), difluoromethane, difluoroethane, ammonia, water/ammonia mixture, or a combination thereof.

Figure 3:
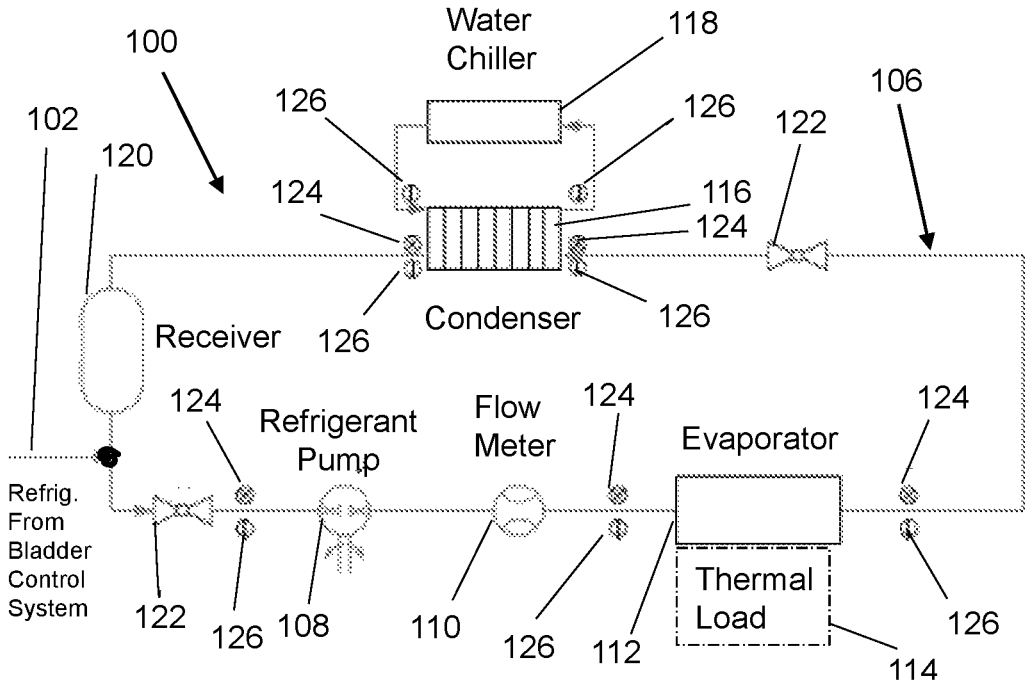
FIG. 3 is an enlarged view of the two-phase pump loop system of FIG. 2.

FIG. 3 illustrates the TPPL system 100 having a two-phase flow loop (TPPL) 106. The refrigerant is circulated about the TPPL 106 by a positive displacement pump 108. The refrigerant pump 108 can be of any suitable type. A volumetric flow rate of the refrigerant in the loop 106 is measured using a flow meter 110 located downstream of the positive displacement pump 108. The flow meter 110 can be of any suitable type. It is noted that the flow meter 110 can alternatively be located at any other suitable location along the TPPL 106. It is noted that the pump 108 and/or the flow meter 110 can alternatively have any other suitable configuration.

Downstream from the pump 108 and the flow meter 110; the refrigerant enters an evaporator or thermal load section 112. The evaporator 112 can be of any suitable type. In the evaporator 112, the refrigerant is used as a coolant to dissipate heat from a heat generating device 114 such as, for example but not limited to, an electrical or optical component of a HEL device. The saturated liquid refrigerant travels through the evaporator 112 and produces two-phase refrigerant flow as heat is absorbed by the refrigerant from the heat generating device 114. It is noted that the evaporator 112 can alternatively have any other suitable configuration.

Downstream from the evaporator 112 is a condenser 116. The liquid-vapor refrigerant mixture from the evaporator 112 travels through the condenser 116 and produces saturated liquid refrigerant as the refrigerant is cooled as heat is rejected. The condenser 116 can be of any suitable type. The illustrated condenser includes one flow path for the refrigerant and another flow path for counter-flowing cooling water which was used to condense the refrigerant from liquid-vapor to the saturated liquid phase. The cooling water is cooled by using a recirculating bath water chiller 118. It is noted that the cooling water can alternatively be cooled in any other suitable manner. It is noted that the condenser 116 can alternatively have any other suitable configuration.

The saturated liquid refrigerant leaving the condenser 116 travels to a vapor-liquid receiver 120 located downstream from the condenser and upstream of the pump 108. The vapor-liquid receiver 120 can be of any suitable type for storing the refrigerant. The vapor-liquid receiver 120 may include any device configured to separate a vapor-liquid mixture into vapor and liquid portions. The vapor-liquid receiver 120 may be a vessel in which gravity causes the liquid portion to settle to a bottom portion of the vessel and the vapor portion to rise to a top portion of the vessel. The outlet of the vapor-liquid receiver 120 includes means for creating a pressure rise. More specifically, the pump 108 is located approximate to the exit of the vapor/liquid receiver 120 in order to create flow of the refrigerant to the evaporator 112. That is, the pump 108 should draw liquid refrigerant from the vapor/liquid receiver 120. It is noted that the receiver 120 can alternatively have any other suitable configuration.

Downstream of the receiver 120 and prior to the pump 108, the bladder control system 200 is connected to TPPL 106 of the TPPL system 100. The refrigerant line 102 is in fluid flow communication with the TPPL 106 between the receiver 120 and the pump 108. It is noted that this connection can alternatively be at any other suitable location.

A pair of valves 122 are arranged along the TPPL 106 to isolate the refrigerant after system shutdown. The valves 122 can be of any suitable type. The first illustrated valve is located between the refrigerant line connecting the bladder cornel system 200 and the pump 208. The second valve is located between the evaporator 112 and the condenser 116. Located in the manner, the condenser, receiver, and bladder control system 200 can be isolated from the remainder of the TPPL 106. It is noted that the valves 122 can alternatively have any other suitable quantity and/or configuration.

Pressure sensors 124 and temperature sensors 126 are located at a plurality of locations along the length of the TPPL 106 for measuring the pressure and temperature of the refrigerant at select locations. The pressure sensors 124 can be pressure transducers or any other suitable pressure measuring device. The temperature sensors 126 can be thermocouples or any other suitable temperature measuring device. A first pair of pressure and temperature sensors 124, 126 is located near the refrigerant inlet of the evaporator 112. A second pair of pressure and temperature sensors 124, 126 is located near the refrigerant outlet of the evaporator 112. A third pair of pressure and temperature sensors 124, 126 is located near the refrigerant inlet of the condenser 116. A fourth pair of pressure and temperature sensors 124, 126 is located near the refrigerant outlet of the condenser 116. A fifth pair of pressure and temperature sensors 124, 126 is located near the refrigerant inlet of the pump 108. Additional temperature sensors are located at the cooling water inlet and outlet respectively of the condenser 116. It is noted that the pressure sensors 124 and/or temperature sensors 126 can alternatively have any other suitable quantity and/or configuration.

Figure 4:
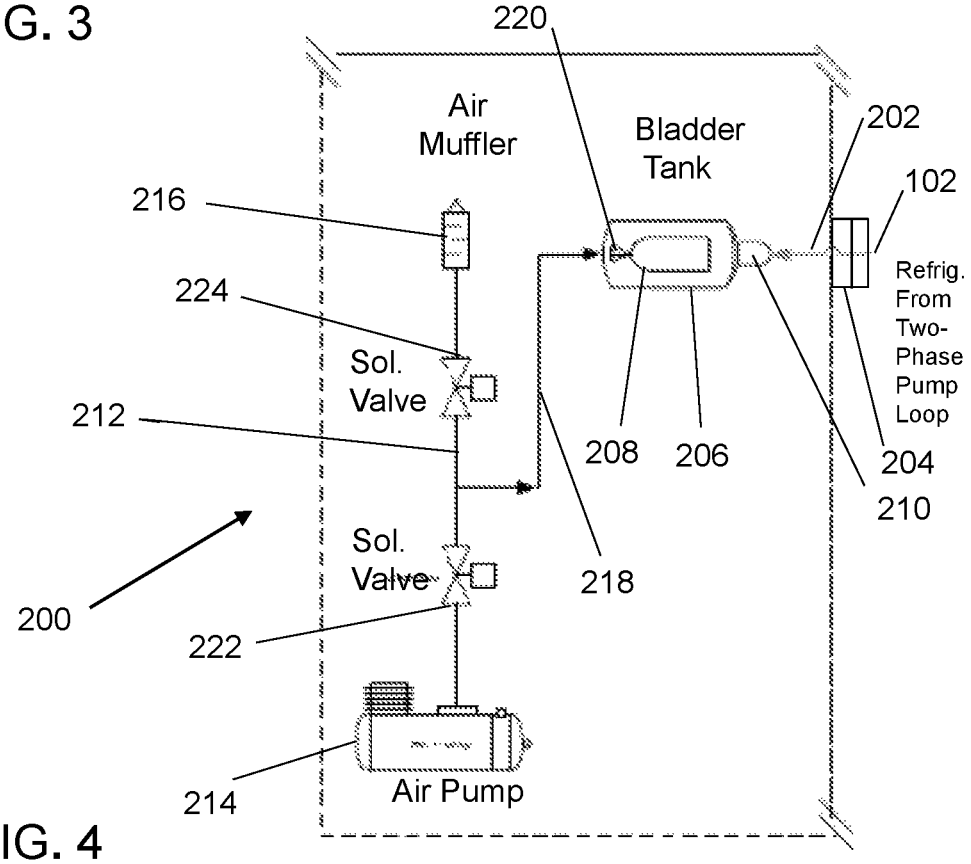
FIG. 4 is an enlarged view of the bladder control system of FIG. 2.
Figure 5:
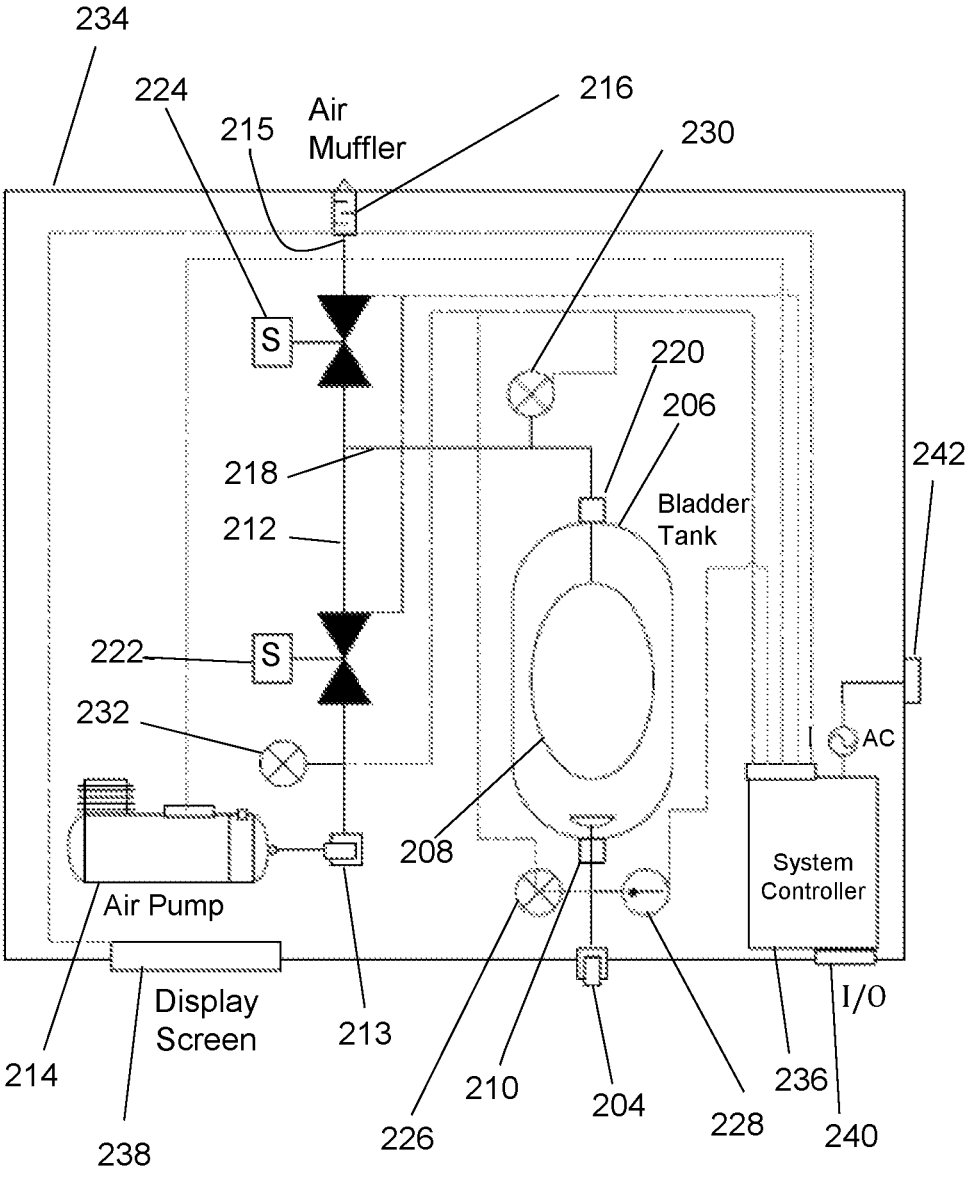
FIG. 5 is a schematic view of a bladder control unit incorporating the bladder control system of FIG. 4.

As best shown in FIGS. 4 and 5, the bladder control system 200 includes a bladder tank 206 having a hollow interior space with an expandable bladder 208 located therein. The external surface of the bladder tank 206 can be steel and a vessel inside contains the bladder which is expandable by compressed air. The refrigerant line 202 is in fluid flow communication with an inlet 210 of the bladder tank 206 so that the interior space of the bladder tank 206 is in fluid flow communication with the TPPL 106 when the refrigerant line 202 of the bladder control system 200 is coupled to the refrigerant line 102 of the TPPL system 100. The expandable bladder 208 comprises an expandable material such as, for example but not limited to, rubber or the like so that when the bladder 208 is expanded, the bladder 208 reduces the volume of the interior space available for the refrigerant so that refrigerant is pushed out of the bladder tank 206 through the refrigerant lines 202, 102 to the TPPL 106 causing a rise in refrigerant pressure within the TPPL 106. When the bladder 208 is contracted, the bladder 208 increases the volume of the interior space available for the refrigerant so that refrigerant is received into the bladder tank 206 through the refrigerant lines 202, 102 from the TPPL 106 causing a reduction in refrigerant pressure within the TPPL 106. Thus, the bladder tank 206 is used to add or subtract refrigerant into or out of the TPPL system 100 to raise or lower the pressure of the refrigerant in the TPPL 106. It is noted that the bladder control system 200 can alternatively have any other suitable configuration.

The illustrated bladder control system 200 also includes air circuit for selectively inflating and deflating the expandable bladder 208. The illustrated air circuit includes a main air line 212 having an air inlet 213 connected to an outlet of an air pump or compressor 214, and an air outlet 215 to release air to atmosphere or another suitable environment. The illustrated air outlet 215 is connected to an air muffler 216. A bladder air line 218 extends from the main air line 212 to a port or inlet 220 of the expandable bladder 208 for air flow from the main air line 212 to the expandable bladder 208. A union tee can be used to connect the bladder air line 218 to the main air line 212. Along the main air line 212, between its air inlet and the air outlet, are spaced-apart and normally-closed first and second solenoid valves 222, 224. The first solenoid valve 222 is located along the main air line 212 between the air pump and the bladder air line 218. The first solenoid valve 222 is selectively opened to allow air to enter the expandable bladder 208 to expand the bladder 208 and push refrigerant out of the bladder tank 206 into the TPPL 106. The air pump 214 provides pressurized air to inflate the expandable bladder 208. The second solenoid valve 224 is selectively opened to allow air to exit the expandable bladder 208 to deflate the bladder 208 and allow refrigerant into bladder tank 206 from the TPPL 106. The air muffler 216 quietly vents the air from the expandable bladder 208 to atmosphere or another suitable environment when the bladder air is released. Thus, operation of the first and second solenoid valves 222, 224 selectively increases and decreases refrigerant pressure in the TPPL 106. It is noted that the air circuit can alternatively have any other suitable configuration.

Pressure and temperature sensors 226, 228 are located along the refrigerant line near the tank inlet 210 to measure refrigerant saturation conditions of the TPPL system 100. The refrigerant pressure and temperature data is communicated to a system controller 236 as discussed in more detail below. The pressure sensor 226 can be a pressure transducer or any other suitable pressure measuring device. The temperature sensor 228 can be a thermocouple or any other suitable temperature measuring device. Another pressure sensor 230 is located in the bladder air line 218 near the bladder port or outlet 220 in order to determine the air pressure within the expandable bladder 208. The bladder pressure data is communicated to the system controller 236 as discussed in more detail below. The pressure sensor 230 can be a pressure transducer or any other suitable pressure measuring device. Yet another pressure sensor 232 is located in the main air line 212 between the air pump 214 and the first solenoid valve 222 to regulate the pressure and control the air pump 214. The pressure sensor 232 can also be used as a redundant safety instrument that communicates pressure data to the system controller 236 as discussed in more detail below. The pressure sensor 232 can be a pressure transducer or any other suitable pressure measuring device.

The bladder control system 200 can be provided within a container or cabinet 234 as shown in FIG. 5. The refrigerant fitting 204 can be provided at a wall of the cabinet 234 to connect with the refrigerant line 102 of the TPPL system 100. Provided within the illustrated cabinet 234 is a system controller 236. The illustrated controller 236 is operably connected to be in communication with the pressure sensors 226, 230, 232, the air pump 214, the first and second solenoid valves 222, 224, a system display screen or monitor 238, and one or more I/O devices 240. The connections can be wired and/or wireless. The system display screen or monitor 238 is used by the user to visually monitor conditions of the TPPL system 100 and the bladder control system 200. The display screen or monitor 238 can be of any suitable type. The user interface or input/out (I/O) devices 240 are provided for a user to enter or receive desired data, information, and/or operating conditions to or from the system controller 236 such as, for example but not limited to, a set maximum system pressure and a set minimum system pressure for the TPPL 106. The I/O devices 240 can be of any suitable type, such as, for example but not limited to, a keypad, a track pad, a toggle, a keyboard, a mouse, and the like.

The system controller 236 is configured so that when the current system pressure is less than the set minimum system pressure, the system controller 236 activates the air pump 214 and opens the first solenoid valve 222 so that air flows to the expandable bladder 208 until the current system pressure is equal to the set minimum system pressure. At this time, the system controller 236 closes the first solenoid valve 222 and deactivates the air pump 214. When the current system pressure is greater than the set maximum system pressure, the system controller 236 activates the second solenoid valve 224 so that pressurized air is released from the expandable bladder 208 through the air muffler 216 to atmosphere or another suitable environment until the current system pressure is equal or less than the set maximum system pressure. At this time, the system controller 236 closes the second solenoid valve 224. The system controller 236 continues monitoring the current system pressure and temperature as long as the TPPL system 100 is operating to maintain the conditions set by the user. The system controller 236 is connected to a 120 VAC power source 242.

The system controller 236 includes one or more microcontrollers and/or microprocessors along with needed memory and software. The software can be firmware, embedded software, and/or application software that is needed for the specific hardware utilized in order to provide all of functions of the pump bladder system 200 described herein such as, for example but not limited to, operation of the air compressor 214, the first and second solenoid valves 222, 224, the pressure and temperature sensors 226, 228, 230, 232, the display screen 238, and the I/O devices 240, and performing all processing functions. It is noted that the controller 236 can have any suitable configuration to carry out the described operation of the pump bladder system 200 with the TPPL 106.

Figure 6:
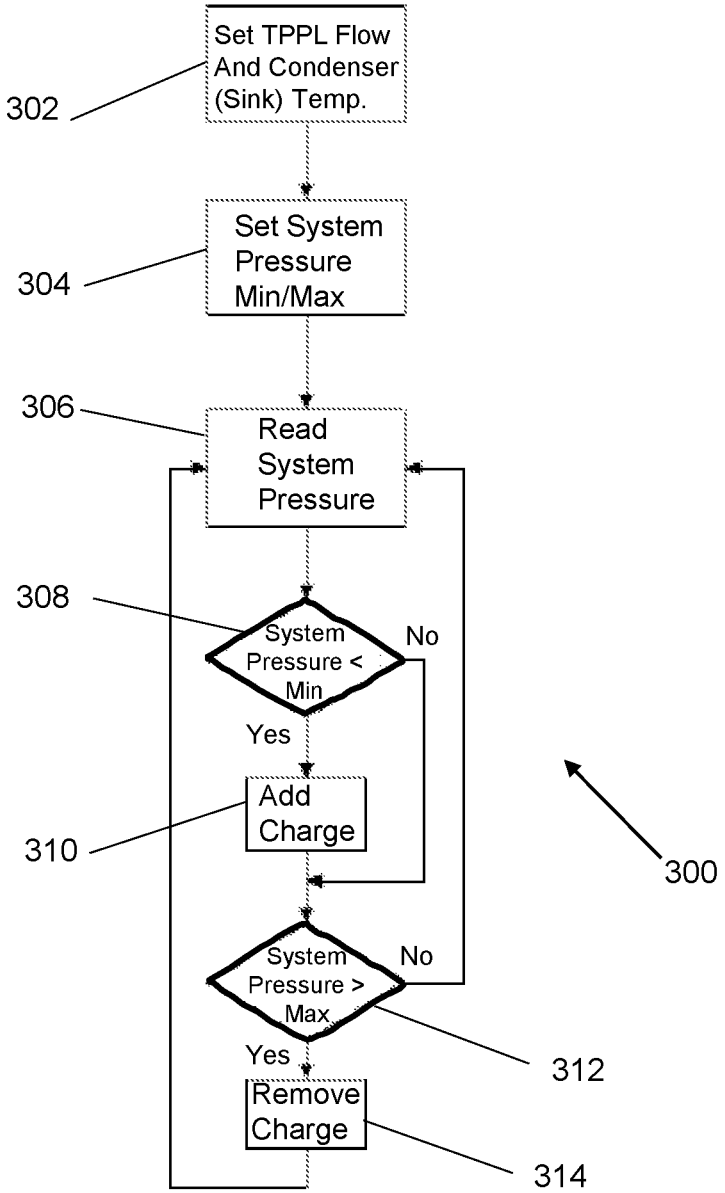
FIG. 6 is a flowchart showing a method for controlling the two-phase pump loop system with the bladder control system of FIG. 2 in accordance with the present invention.

FIG. 6 illustrates a flowchart 300 for a method of controlling the TPPL 106 with the pump bladder system 200. In the illustrated method, a user first sets 302 desired operating conditions for the TPPL system 100 on the system controller 236. The illustrated operating conditions are flow rate and condenser (sink) temperature. It is noted that additional and/or different operating conditions can alternatively be utilized if desired. The controller 236 monitors the operating conditions of the TPPL system 100 using the flow meter 110 and/or the temperature and pressure sensors of the TPPL system 100. Next, the user sets 304 a minimum system pressure and a maximum system pressure on the system controller 236. The system controller 236 continuously monitors/reads 306 the current system pressure and temperature from the pressure and temperature sensors 124, 126 of the TPPL system 100 and/or the pressure and temperature sensors 226, 228 of the pump bladder system 200.

If the system controller 236 determines 308 that the current system pressure is less than the set minimum system pressure, the system controller 236 automatically activates/opens 310 the first solenoid valve 222 so that compressed air is supplied to the expandable bladder 208 to add a refrigerant charge to the TPPL system 100 until the current system pressure is equal to or greater than the set minimum system pressure. Once the current system pressure is at or above the set minimum system pressure, the system controller 236 deactivates/closes the first solenoid valve 222 to stop the air flow into the expandable bladder 208 and thus stop the refrigerant charge into the TPPL system 100 from the pump bladder system 200. The system controller 236 continues to monitor/read the current system pressure and temperature from the pressure and temperature sensors 124, 126 of the TPPL system 100 and/or the pressure and temperature sensors 226, 228 of the pump bladder system 200.

If the system controller 236 determines 312 that the current system pressure is greater than the set maximum system pressure, the system controller 236 automatically activates/opens the second solenoid valve 224 so that air pressure within the expandable bladder 208 is released to atmosphere or anther suitable environment through the air muffler 216 to remove 314 a charge of refrigerant from the TPPL system 100 to the refrigerant tank 206 of the pump bladder system 200 until the current system pressure is equal or less than the set maximum system pressure. Once the current system pressure is equal or less than the set maximum system pressure, the system controller 236 deactivates/closes the second solenoid valve 224 to stop the air flow out of the expandable bladder 208 and thus stop the refrigerant charge out of the TPPL system 100 to the pump bladder system 200. The system controller 236 continues monitoring/reading the current system pressure and temperature as long as the TPPL system 100 is operating. It is noted that tight temperature control can be provided at the thermal load 112 of the two-phase pump loop 106 by proper selection of the inputted set minimum system pressure and the inputted set maximum system pressure.

As can be seen from the above description, the disclosed thermal management system transfers heat from a thermal load to an ambient environment while maintaining tight temperature control at the heat load in an effective manner and the disclosed method of transferring heat from a thermal load to an ambient environment maintains tight temperature control at the heat load in an effective manner. Additionally, they do so in a cost-effective manner. As a result, the systems and methods according to the invention disclosed herein are an improvement over the prior art.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A bladder control system for a two-phase pump loop comprising:

an air compressor having an outlet;

an air outlet;

a refrigerant tank having a port configured for connection with the two-phase pump loop for selective flow of refrigerant between the refrigerant tank and the two-phase pump loop;

an expandable bladder located within the refrigerant tank and having a port selectively connected to the outlet of the air compressor and selectively connected to the air outlet;

a controller configured and operably connected to the air compressor to selectively expand and contract the expandable bladder within the refrigerant tank to control flow of refrigerant through the port of the refrigerant tank, wherein expansion of the expandable bladder discharges refrigerant from the bladder tank though the port of the bladder tank and contraction of the expandable bladder intakes refrigerant into the bladder tank though the port of the bladder tank;

an air line having an inlet and an outlet, wherein the inlet of the air line is operably connected to the outlet of the air compressor for selective air flow from the air compressor to the air line, and the outlet of the air line forms the air outlet;

first and second solenoid valves located along the air line;

wherein the port of the expandable bladder is connected to the air line between the first and second solenoid valves for selective flow of air between the expandable bladder and the air line; and wherein the controller operably connected to the air compressor, the first solenoid valve, and the second solenoid valve to selectively expand and contract the expandable bladder.

2. The bladder control system according to claim 1, further comprising a pressure sensor located and operably connected to the controller to provide system pressure to the controller.

3. The bladder control system according to claim 1, further comprising an air muffler operably connected to the air outlet so that air exiting the air outlet passes through the air muffler.

4. The bladder control system according to claim 1, further comprising a pressure sensor located and operatively connected to the controller to provide air pressure within the expandable bladder to the controller.

5. The bladder control system according to claim 1, further comprising a pressure sensor located and operably connected to the controller to provide system refrigerant pressure to the controller.

6. The bladder control system according to claim 1, wherein the controller is configured to receive a set minimum system pressure and a set maximum system pressure and to operate the air compressor, the first solenoid valve, and the second solenoid valve to maintain system refrigerant pressure within the set minimum system pressure and the set maximum system pressure.

7. The bladder control system according to claim 1, further comprising an air muffler operably connected to the air outlet so that air exiting the air outlet passes through the air muffler.

8. The bladder control system according to claim 1, further comprising a pressure sensor located and operatively connected to the controller to provide air pressure in the air line between the air compressor and the first solenoid valve to the controller.

9. A two-phase pump loop system comprising:

a two-phase pump loop comprising:

vapor/liquid receiver configured to hold both vapor and liquid forms of refrigerant;

a pump located downstream of the vapor/liquid receiver, and configured to pump the refrigerant through the two-phase pump loop;

an evaporator located downstream of the pump and configured for the refrigerant passing therethrough to absorb heat; and a condenser located downstream of the evaporator and configured to reject from the refrigerant passing therethrough;

wherein refrigerant exiting the condenser is returned to the vapor/liquid receiver; and a bladder control system comprising:

an air compressor having an outlet;

an air outlet;

a refrigerant tank having a port operably connected to the two-phase pump loop for selective flow of refrigerant between the refrigerant tank and the two-phase pump loop;

an expandable bladder located within the refrigerant tank and having a port selectively connected to the outlet of the air compressor and selectively connected to the air outlet; and a controller configured and operably connected to the air compressor to selectively expand and contract the expandable bladder within the refrigerant tank to control flow of refrigerant through the port of the refrigerant tank, wherein expansion of the expandable bladder discharges refrigerant from the bladder tank though the port of the bladder tank to the two-phase pump loop and contraction of the expandable bladder intakes refrigerant into the bladder tank though the port of the bladder tank from the two-phase pump loop;

an air line having an inlet and an outlet, wherein the inlet of the air line is operably connected to the outlet of the air compressor for selective air flow from the air compressor to the air line, and the outlet of the air line forms the air outlet;

first and second solenoid valves located along the air line;

wherein the port of the expandable bladder is connected to the air line between the first and second solenoid valves for selective flow of air between the expandable bladder and the air line; and wherein the controller configured and operably connected to the air compressor, the first solenoid valve, and the second solenoid valve to selectively expand and contract the expandable bladder.

10. The two-phase pump loop system according to claim 9, further comprising a pressure sensor located and operably connected to the controller to provide system pressure to the controller.

11. The two-phase pump loop system according to claim 9, further comprising an air muffler operably connected to the air outlet so that air exiting the air outlet passes through the air muffler.

12. The two-phase pump loop system according to claim 9, further comprising a pressure sensor located and operatively connected to the controller to provide air pressure within the expandable bladder to the controller.

13. The two-phase pump loop system according to claim 9, further comprising a pressure sensor located and operably connected to the controller to provide system refrigerant pressure to the controller.

14. The two-phase pump loop system according to claim 9, wherein the controller is configured to receive a set minimum system pressure and a set maximum system pressure and to operate the air compressor, the first solenoid valve, and the second solenoid valve to maintain the system pressure within the set minimum system pressure and the set maximum system pressure.

15. The two-phase pump loop system according to claim 9, further comprising an air muffler operably connected to the air outlet so that air exiting the air outlet passes through the air muffler.

16. The two-phase pump loop system according to claim 9, further comprising a pressure sensor located and operatively connected to the controller to provide air pressure in the air line between the air compressor and the first solenoid valve to the controller.

17. A method of operating a bladder control system for a two-phase pump loop, comprising the steps of:

wherein the bladder control system comprises an air compressor having an outlet, an air outlet, a refrigerant tank having a port configured for connection with the two-phase pump loop for selective flow of refrigerant between the refrigerant tank and the two-phase pump loop, an expandable bladder located within the refrigerant tank and having a port selectively connected to the outlet of the air compressor and selectively connected to the air outlet, and a controller configured and operably connected to the air compressor to selectively expand and contract the expandable bladder within the refrigerant tank to control flow of refrigerant through the port of the refrigerant tank, wherein expansion of the expandable bladder discharges refrigerant from the bladder tank though the port of the bladder tank and contraction of the expandable bladder intakes refrigerant into the bladder tank though the port of the bladder tank;

wherein the bladder control system further comprises an air line having an inlet and an outlet, wherein the inlet of the air line is operably connected to the outlet of the air compressor for selective air flow from the air compressor to the air line, and the outlet of the air line forms the air outlet; first and second solenoid valves located along the air line; wherein the port of the expandable bladder is connected to the air line between the first and second solenoid valves for selective flow of air between the expandable bladder and the air line; and wherein the controller operably connected to the air compressor, the first solenoid valve, and the second solenoid valve to selectively expand and contract the expandable bladder;

inputting a set minimum system pressure and a set maximum system pressure to the system controller;

providing a reading of current system pressure to the system controller;

determining, by the system controller, whether the current system pressure is less than the set minimum system pressure;

if the current system pressure is less than the set minimum system pressure, automatically supplying, by the system controller, compressed air to the expandable bladder to add a refrigerant charge to the two-phase pump loop until the current system pressure is equal to or greater than the set minimum system pressure;

determining, by the system controller, whether the current system pressure is greater than the set maximum system pressure;

if the current system pressure is greater than the set maximum system pressure, automatically releasing, by the system controller, compressed air from the expandable bladder to remove a refrigerant charge from the two-phase pump loop until the current system pressure is equal to or less than the set maximum system pressure.

18. The method of claim 17, providing tight temperature control at a thermal load of the two-phase pump loop by selection of the inputted set minimum system pressure and the inputted set maximum system pressure.

* * * * *